US007549423B1

(12) United States Patent
Hirshberg

(10) Patent No.: US 7,549,423 B1
(45) Date of Patent: Jun. 23, 2009

(54) MOUTHGUARD HAVING BREATHING HOLES INCORPORATED THEREIN

(75) Inventor: Jonathan Hirshberg, Manhattan Beach, CA (US)

(73) Assignee: JR286 Technologies, Inc., Redondo Beach, CA (US)

( * ) Notice: Subject to any disclaimer, the term of this patent is extended or adjusted under 35 U.S.C. 154(b) by 0 days.

(21) Appl. No.: 11/824,872

(22) Filed: Jul. 2, 2007

(51) Int. Cl.
*A61C 5/14* (2006.01)
*A61C 3/00* (2006.01)

(52) U.S. Cl. ..... 128/861; 128/848; 128/859; 128/862; 433/6

(58) Field of Classification Search ..... 128/861, 128/862, 848, 859, 860; 433/6, 7, 18, 19, 433/24

See application file for complete search history.

(56) References Cited

U.S. PATENT DOCUMENTS 3,768,465 A * 10/1973 Helmer ..... 128/862
5,611,355 A * 3/1997 Hilsen ..... 128/848
7,422,017 B2 * 9/2008 Bancroft ..... 128/859

* cited by examiner

*Primary Examiner*—Patricia Bianco
*Assistant Examiner*—Ophelia Hawthorne
(74) *Attorney, Agent, or Firm*—Thomas I. Rozsa

(57) ABSTRACT

The present invention is an improved mouthguard which has incorporated into it at least one and preferably a multiplicity of breathing holes which extend from the front of the mouthguard which can protrude through the wearer's mouth into the air and also provide a passageway for the air to travel to the wearer's throat while the mouthguard is gripped between the wearer's teeth. As a result, the wearer is able to breathe through the wearer's mouth while gripping the mouthguard between the wearer's teeth to protect the teeth during an athletic event.

28 Claims, 10 Drawing Sheets

MOUTHGUARD HAVING BREATHING HOLES INCORPORATED THEREIN

BACKGROUND OF THE INVENTION

1. Field of the Invention

The present invention relates to the field of mouthguards which are used by athletes during a sporting event to help protect the athlete's teeth.

2. Description of the Prior Art

In general, various configurations for mouthguards are known in the prior art. However, one problem with all mouthguards is that the athlete is not able to breathe through his/her mouth while the mouthguard is in place in the athlete's mouth. As a result, the athlete has to remove the mouthguard periodically, such as between plays in a football game, in order to breathe through the athlete's mouth.

There is a significant need for an improved mouthguard which enables an athlete to breathe through his/her mouth while wearing the mouthguard in the athlete's mouth.

SUMMARY OF THE INVENTION

The present invention is an improved mouthguard which has incorporated into it at least one and preferably a multiplicity of breathing holes which extend from the front of the mouthguard which can protrude through the wearer's mouth into the air and also provide a passageway for the air to travel to the wearer's throat while the mouthguard is gripped between the wearer's teeth. As a result, the wearer is able to breathe through the wearer's mouth while gripping the mouthguard between the wearer's teeth to protect the teeth during an athletic event.

It has been discovered, according to the present invention, that if a mouthguard is designed with a front protruding section which extends between a wearer's lips while the mouthguard is retained between the wearer's teeth, and the front protruding section has at least one through hole which extends from the outside into the wearer's mouth, then the wearer can grip the mouthguard between the wearer's teeth and at the same time breathe through the at least one through hole so that the wearer can breathe during a play of an athletic event and does not have to remove the mouthguard to breathe through the wearer's mouth.

It has further been discovered, according to the present invention, that if the mouthguard has three aligned openings, it will improve the breathing ability of the wearer.

It is therefore an object of the present invention to provide a mouthguard which is designed with a front protruding section which extends between a wearer's lips while the mouthguard is retained between the wearer's teeth, and in which the front protruding section has at least one through hole which extends from the outside into the wearer's mouth so that the wearer can grip the mouthguard between the wearer's teeth and at the same time breathe through the at least one through hole so that the wearer can breathe during a play of an athletic event and does not have to remove the mouthguard to breathe through the wearer's mouth.

It is a further object of the present invention to provide a mouthguard which has three aligned openings to thereby improve the breathing ability of the wearer.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
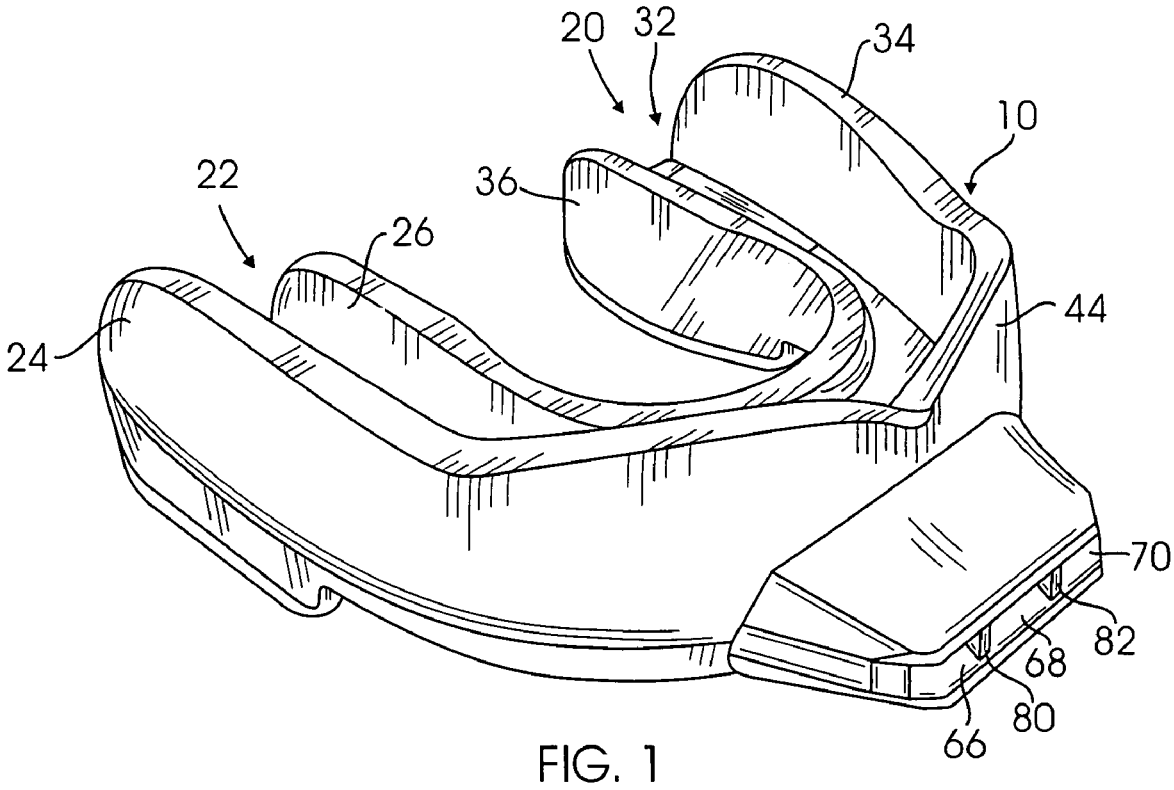
FIG. 1 is a perspective view of a preferred embodiment of the present invention mouthguard having breathing openings incorporated therein.
Figure 2:
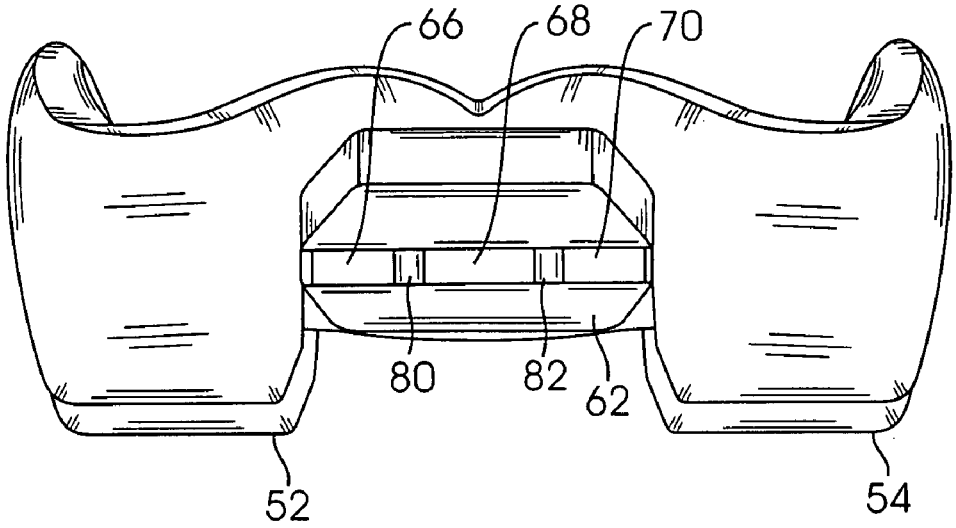
FIG. 2 is a front elevational view of the preferred embodiment of the present invention mouthguard having breathing openings incorporated therein.
Figure 3:
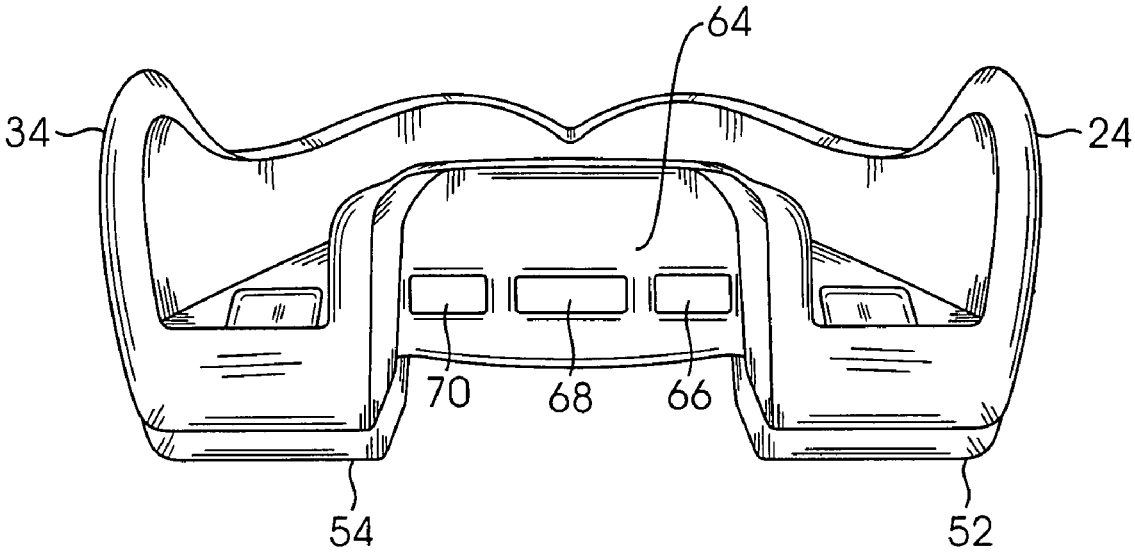
FIG. 3 is a rear elevational view of the preferred embodiment of the present invention mouthguard having breathing openings incorporated therein.
Figure 4:
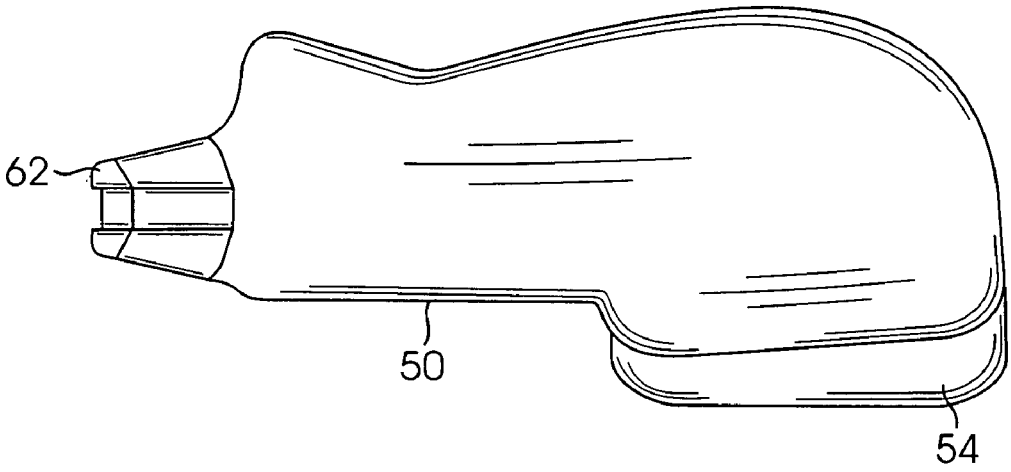
FIG. 4 is a side elevational view when viewed from the right side of the preferred embodiment of the present invention mouthguard having breathing openings incorporated therein.
Figure 5:
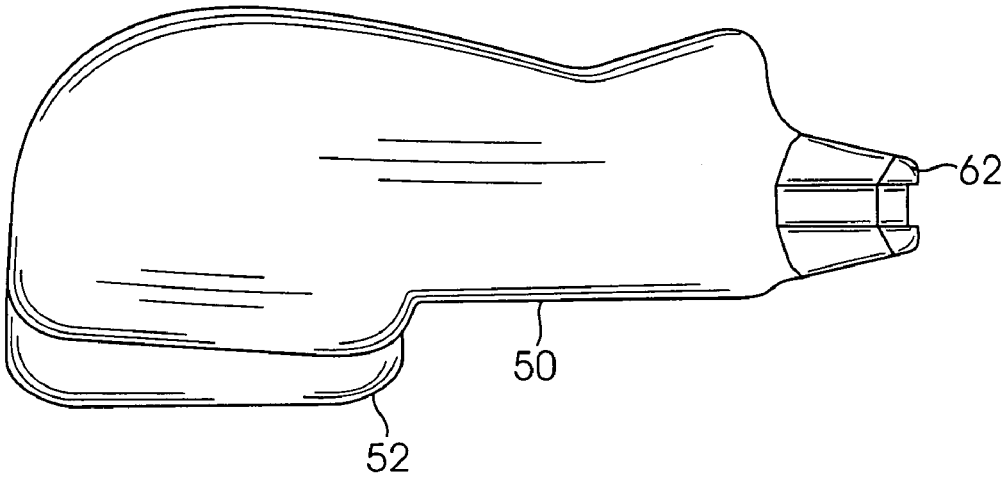
FIG. 5 is a side elevational view when viewed from the left side of the preferred embodiment of the present invention mouthguard having breathing openings incorporated therein.
Figure 6:
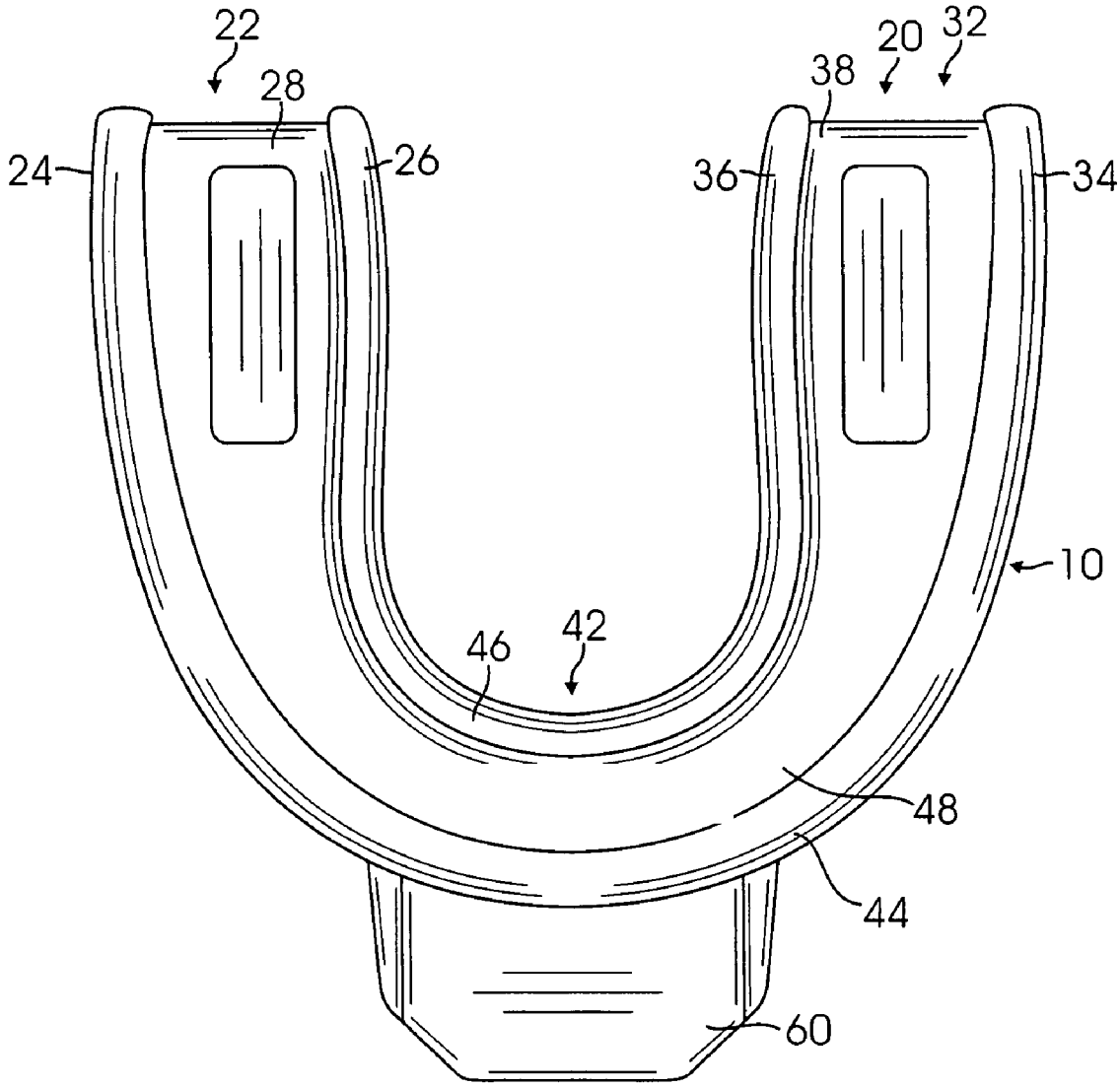
FIG. 6 is a top plan of the preferred embodiment of the present invention mouthguard having breathing openings incorporated therein.

Referring to FIGS. 1 through 7 there is illustrated the preferred embodiment of the present invention mouthguard having breathing openings incorporated therein. The mouthguard 10 comprises teeth protecting means which by way of example may include a first upper section 20 as best illustrated in FIGS. 1 and 6 which includes a first upper teeth tray section 22 having an exterior vertical wall 24, an interior vertical wall 26 and a transverse wall 28 there between. Similarly, the mouthguard 10 upper section 20 further comprises a second upper teeth tray section 32 having an exterior vertical wall 34, an interior vertical wall 36 and a transverse wall 38 there between. The first and second upper sections 22 and 32 extend to a middle teeth tray section 42 having an exterior vertical wall 44, an interior vertical wall 46 and a transverse wall 48 there between. The three sections are designed to retain the upper teeth of a wearer with the right upper teeth resting against transverse wall 28 and retained between vertical walls 24 and 26, the left upper teeth resting against transverse wall 38 and retained between vertical walls 34 and 36, the middle upper teeth resting against transverse wall 48 and retained between vertical walls 44 and 46.

Figure 7:
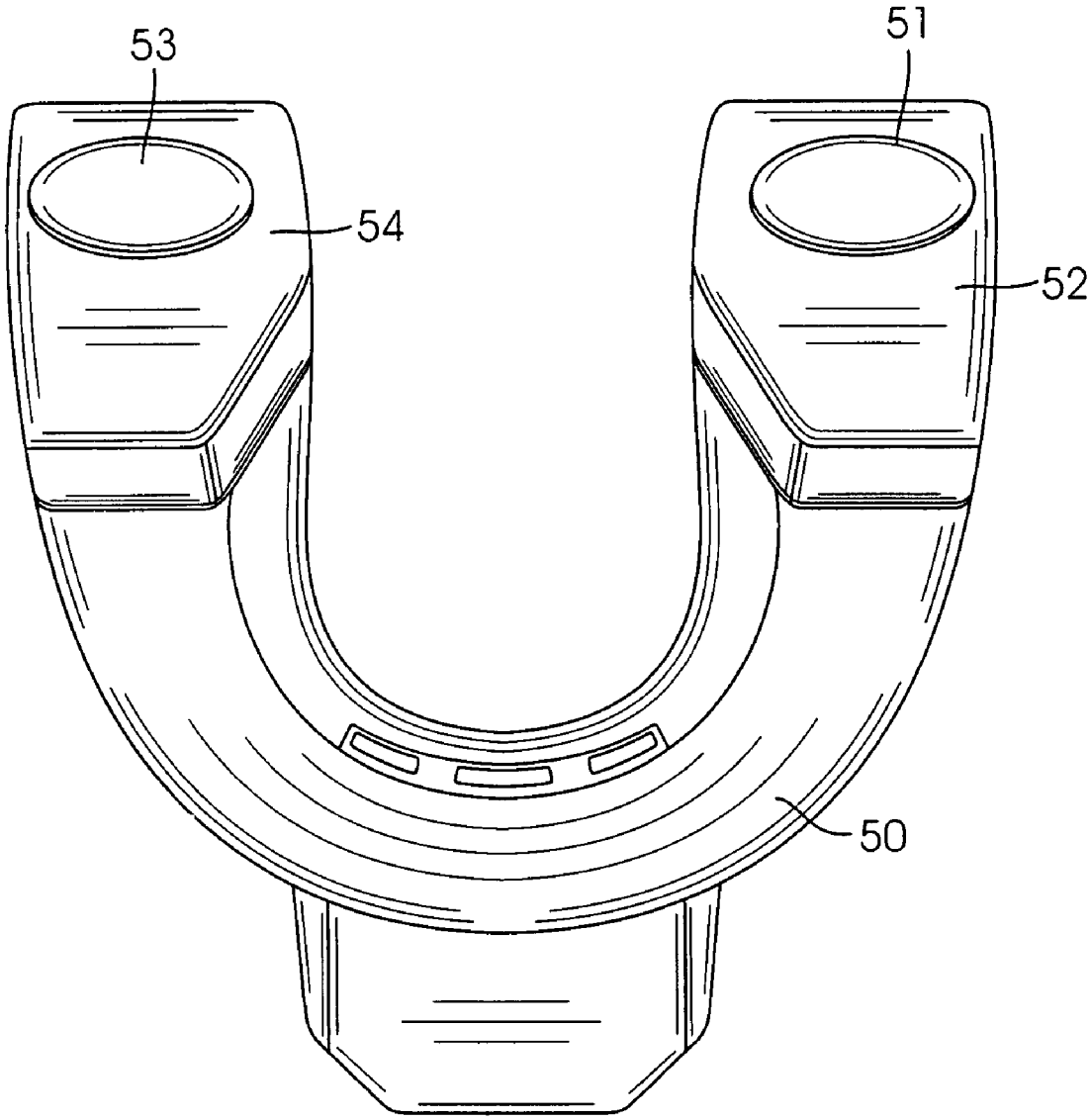
FIG. 7 is a bottom plan of the preferred embodiment of the present invention mouthguard having breathing openings incorporated therein.

The mouthguard 10 also comprises a lower wall which is aligned with the three upper sections 22, 32 and 42 and in this embodiment has a flat surface 50 best illustrated in FIG. 7 which rests against the lower teeth when the mouthguard is in place. It will be appreciated that it is within the spirit and scope of the present invention for the lower surface 50 to also have a transverse section and vertical walls to more securely retain the lower teeth.

The lower surface also comprises a rear raised first section 52 and a second rear raised section 54 which assist in having the back lower teeth more firmly grip the mouthguard. A logo area 51 and 53 are optionally locate on each respective rear raised section.

The innovation of the present invention is the incorporation of a front protruding section 60 which extends forwardly from the teeth protecting sections so that the front protruding section will extend between the wearer's lips when the mouthguard is worn in place and gripped between the upper row of teeth and lower row of teeth in the wearer's mouth. In one preferred embodiment as illustrated, the front protruding section 60 extends from the middle interior wall 44 of middle teeth tray section 42. The protruding section has a front end 62 and a rear end 64 and is configured so that the front end 62 extends so that it is communication with the air around the wearer's head and the rear end 64 faces the interior of the wearer's mouth.

As illustrated, the front protruding section 60 has three aligned breathing holes or openings 66, 68 and 70 which extend from the front end 62 to the rear end 64 of the front protruding section 60. The front protruding section 60 is illustrated as having a generally rectangular front end 62 and the breathing holes are generally rectangular in configuration. It will appreciated that it is within the spirit and scope of the present invention to include at least one breathing hole extending from the front end 62 to the rear end 64 of the front protruding section 60. In addition, any multiplicity of such breathing holes can be incorporated in the front protruding section of the present invention. As best illustrated in the side views of FIGS. 4 and 5, in the preferred embodiment, the breathing holes are set back from the leading edge 62 of the front protruding section. A first vertical wall 80 separates breathing openings 66 and 68 and a second vertical wall 82 separates breathing openings 68 and 70. It will be appreciated that it is within the spirit and scope of the present invention for the breathing openings 66, 68 and 70 to be aligned with the front end 62 and not set back as illustrated in FIGS. 4 and 5.

The breathing holes or openings 66, 68 and 70 permit air to travel from the air surrounding the wearer's head into the wearer's mouth while the mouthguard 10 is gripped between the wearer's teeth. As a result, the wearer is able to breath through the wearer's mouth while retaining the mouthguard in the wearer's mouth to protect the wearer's teeth.

The present invention provides significant advantages over prior art mouthguards which do not have breathing holes incorporated therein. By way of example, during a football game, after each play is over, the player must remove the mouthguard in order to breathe through his mouth. In some designs the mouthguard is attached to a helmet which can create problems if the helmet is knocked off. In other designs where the mouthguard is loose, the player either has to hold the mouthguard in his hand or place it his helmet. Either way, the practice is unsanitary and germs can then be transmitted to the player's mouth when the player reinserts the mouthguard in his mouth. Through the incorporation of breathing holes, the player can continue to retain the mouthguard in his mouth after the play is over. The ability to breath through the player's mouth also improves the player's performance during the athletic event.

The present invention mouthguard can be molded out of a single piece of strong material such as rubber, resin, pvc, or various synthetic plastic compounds.

Figure 8:
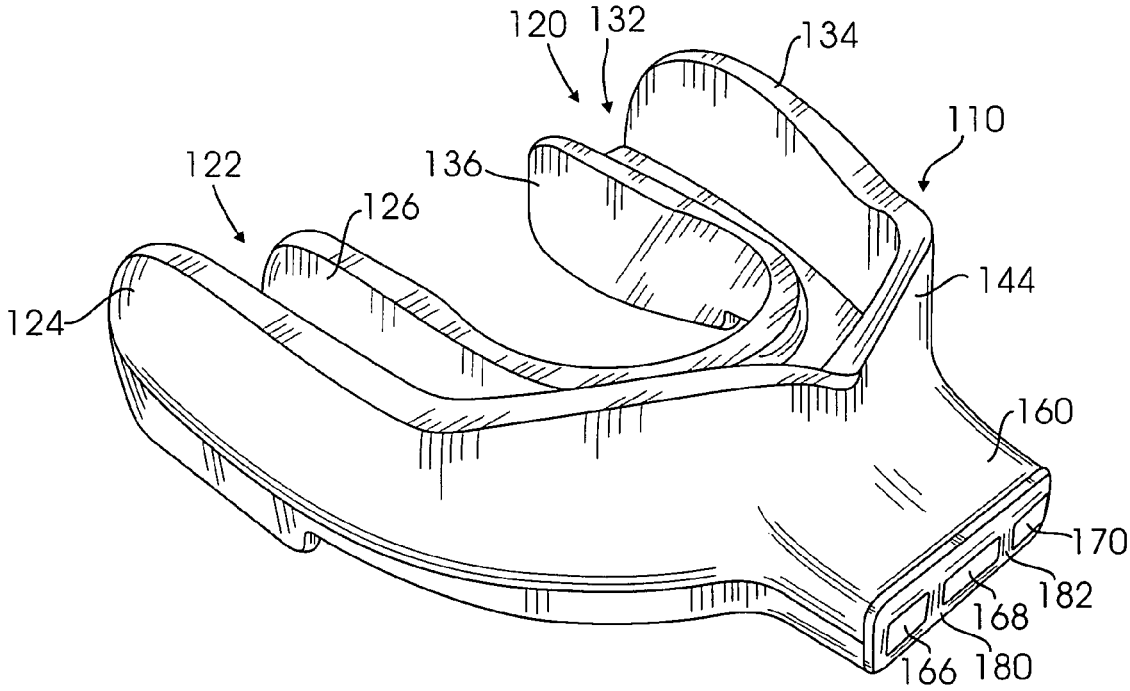
FIG. 8 is a perspective view of an alternative embodiment of the present invention mouthguard having breathing openings incorporated therein.
Figure 9:
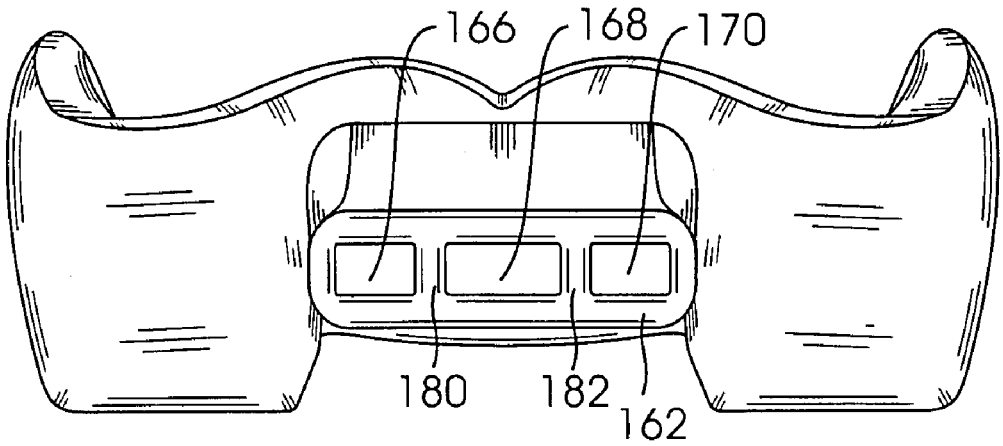
FIG. 9 is a front elevational view of the alternative embodiment of the present invention mouthguard having breathing openings incorporated therein.
Figure 10:
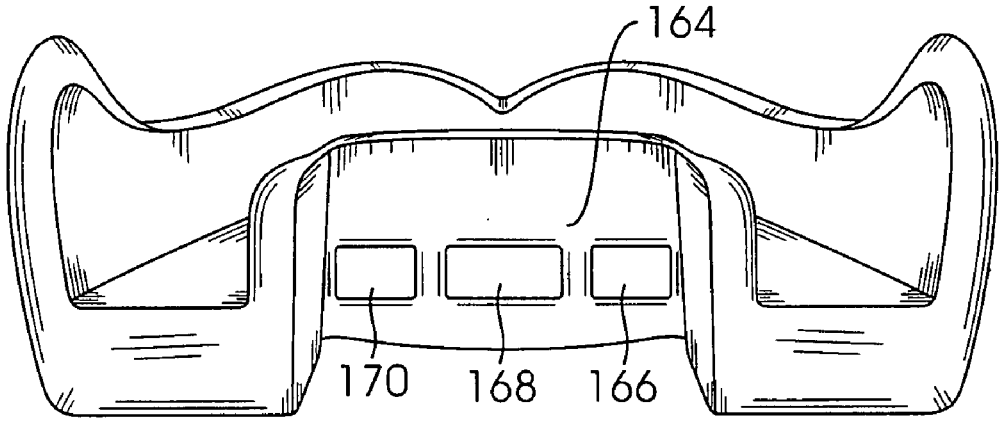
FIG. 10 is a rear elevational view of the alternative embodiment of the present invention mouthguard having breathing openings incorporated therein.
Figure 11:
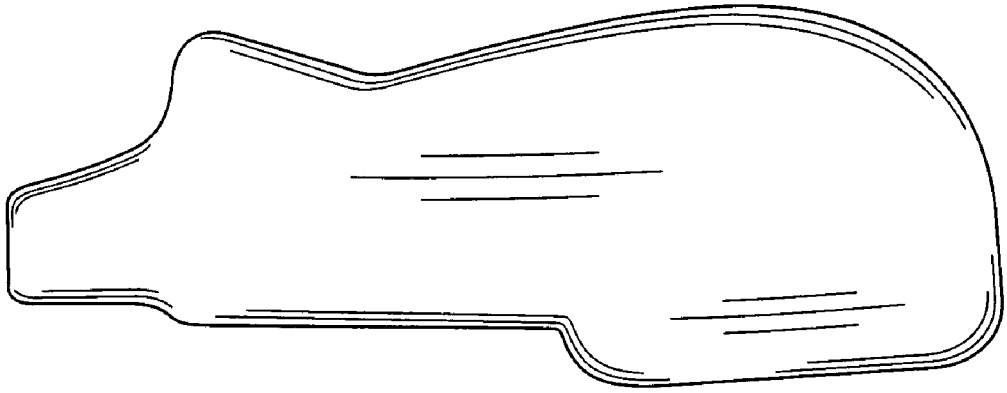
FIG. 11 is a side elevational view when viewed from the right side of the alternative embodiment of the present invention mouthguard having breathing openings incorporated therein.
Figure 12:
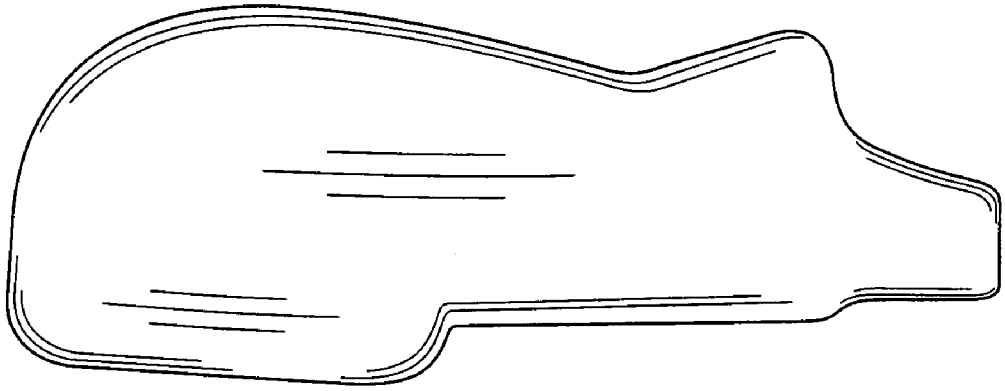
FIG. 12 is a side elevational view when viewed from the left side of the alternative embodiment of the present invention mouthguard having breathing openings incorporated therein.
Figure 13:
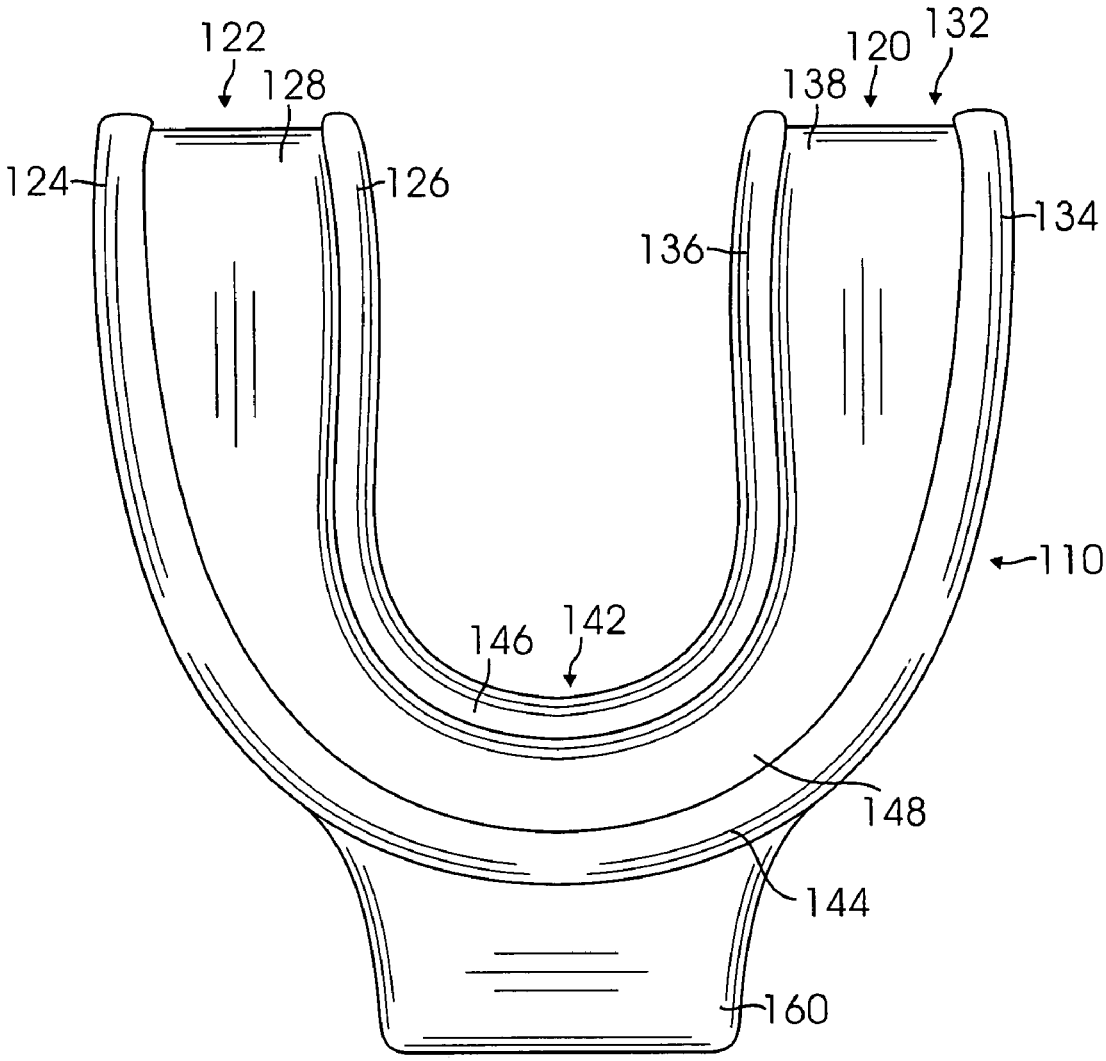
FIG. 13 is a top plan of the alternative embodiment of the present invention mouthguard having breathing openings incorporated therein.

An alternative embodiment of the present invention mouthguard with incorporated breathing holes or openings is illustrated in FIGS. 8 through 14. The mouthguard 110 comprises teeth protecting means which by way of example may include a first upper section 120 as best illustrated in FIGS. 8 and 13 which includes a first upper teeth tray section 122 having an exterior vertical wall 124, an interior vertical wall 126 and a transverse wall 128 there between. Similarly, the mouthguard 110 upper section 120 further comprises a second upper teeth tray section 132 having an exterior vertical wall 134, an interior vertical wall 136 and a transverse wall 138 there between. The first and second upper sections 122 and 132 extend to a middle teeth tray section 142 having an exterior vertical wall 144, an interior vertical wall 146 and a transverse wall 148 there between. The three sections are designed to retain the upper teeth of a wearer with the right upper teeth resting against transverse wall 128 and retained between vertical walls 124 and 126, the left upper teeth resting against transverse wall 138 and retained between vertical walls 134 and 136, the middle upper teeth resting against transverse wall 148 and retained between vertical walls 144 and 146.

Figure 14:
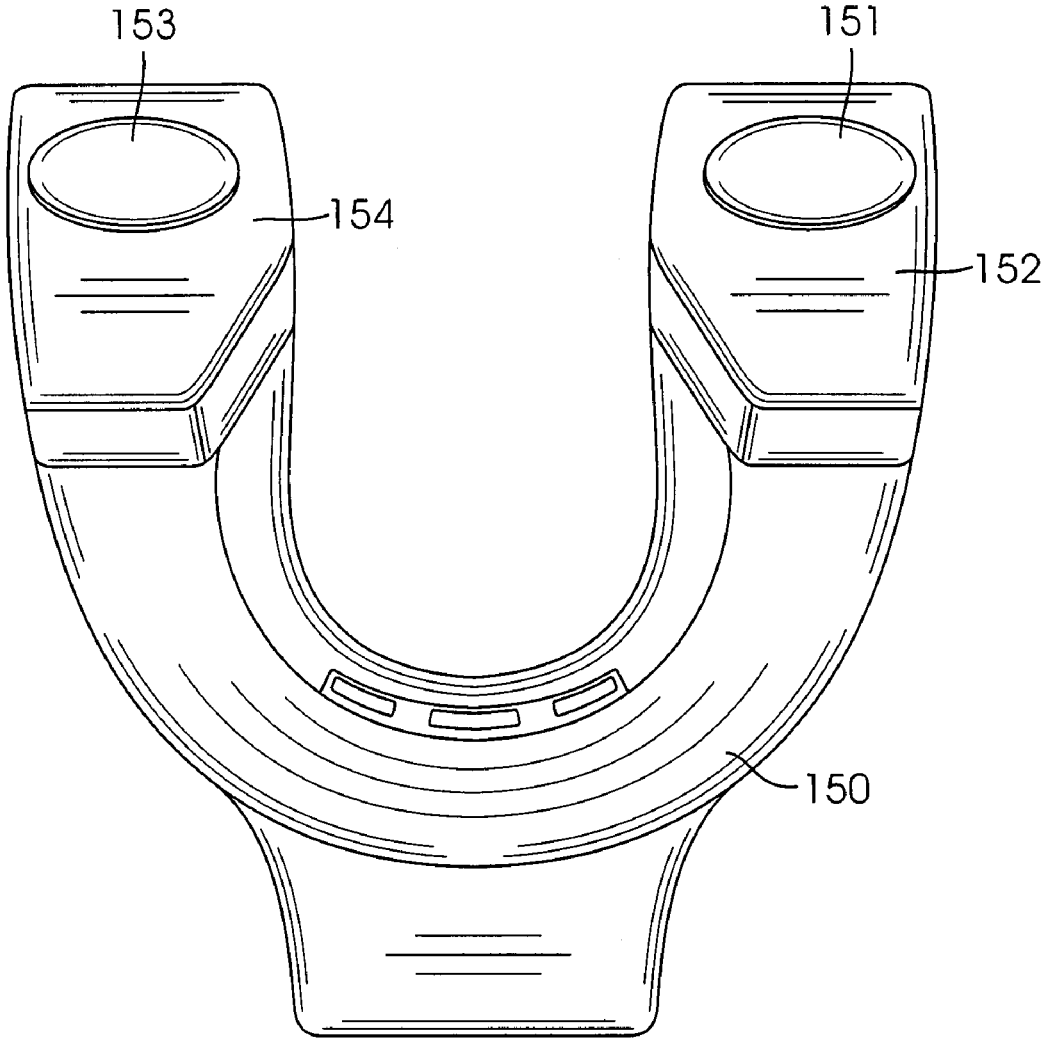
FIG. 14 is a bottom plan of the alternative embodiment of the present invention mouthguard having breathing openings incorporated therein.

The mouthguard 110 also comprises a lower wall which is aligned with the three upper sections 122, 132 and 142 and in this embodiment has a flat surface 150 best illustrated in FIG. 14 which rests against the lower teeth when the mouthguard is in place. It will be appreciated that it is within the spirit and scope of the present invention for the lower surface 150 to also have a transverse section and vertical walls to more securely retain the lower teeth. The lower surface also comprises a rear raised first section 152 and a second rear raised section 154 which assist in having the back lower teeth more firmly grip the mouthguard. A logo area 151 and 153 are optionally locate on each respective rear raised section.

The innovation of the present invention is the incorporation of a front protruding section 160 which extends forwardly from the teeth protecting sections so that the front protruding section will extend between the wearer's lips when the mouthguard is worn in place and gripped between the upper row of teeth and lower row of teeth in the wearer's mouth. In one preferred embodiment as illustrated, the front protruding section 160 extends from the middle interior wall 144 of middle teeth tray section 142. The protruding section has a front end 162 and a rear end 164 and is configured so that the front end 162 extends so that it is communication with the air around the wearer's head and the rear end 164 faces the interior of the wearer's mouth.

As illustrated, the front protruding section 160 has three aligned breathing holes or openings 166, 168 and 170 which extend from the front end 162 to the rear end 164 of the front protruding section 160. The front protruding section 160 is illustrated as having a generally rectangular front end 162 and the breathing holes are generally rectangular in configuration. It will appreciated that it is within the spirit and scope of the present invention to include at least one breathing hole extending from the front end 162 to the rear end 164 of the front protruding section 160. In addition, any multiplicity of such breathing holes can be incorporated in the front protruding section of the present invention. As best illustrated in the view of FIG. 8, in the alternative embodiment, the breathing holes are aligned with the leading edge 62 of the front protruding section. A first vertical wall 180 separates breathing openings 166 and 168 and a second vertical wall 182 separates breathing openings 168 and 170. It will be appreciated that it is within the spirit and scope of the present invention for the breathing openings 166, 168 and 170 to be set back from the front end 62.

The breathing holes or openings 166, 168 and 170 permit air to travel from the air surrounding the wearer's head into the wearer's mouth while the mouthguard 110 is gripped between the wearer's teeth. As a result, the wearer is able to breath through the wearer's mouth while retaining the mouthguard in the wearer's mouth to protect the wearer's teeth.

The present invention provides significant advantages over prior art mouthguards which do not have breathing holes incorporated therein. By way of example, during a football game, after each play is over, the player must remove the mouthguard in order to breathe through his mouth. In some designs the mouthguard is attached to a helmet which can create problems if the helmet is knocked off. In other designs where the mouthguard is loose, the player either has to hold the mouthguard in his hand or place it his helmet. Either way, the practice is unsanitary and germs can then be transmitted to the player's mouth when the player reinserts the mouthguard in his mouth. Through the incorporation of breathing holes, the player can continue to retain the mouthguard in his mouth after the play is over. The ability to breath through the player's mouth also improves the player's performance during the athletic event.

The present invention mouthguard can be molded out of a single piece of strong material such as rubber, resin, pvc, or various synthetic plastic compounds.

Defined in detail, the present invention is a mouthguard comprising: (a) a teeth protecting means section including a front wall; and (b) a protruding section extending from the front wall of the teeth protecting means section, the protruding section having a body, a front end, a rear end, and three aligned breathing holes extending through the body of the protruding section from the front end to the rear end, the breathing openings set back from the front end and separated by a pair of spaced apart vertical walls.

Defined more broadly, the present invention is a mouthguard comprising: (a) a teeth protecting means section including a front wall; and (b) a protruding section extending from the front wall of the teeth protecting means section, the protruding section having a body, a front end, a rear end, and at least one breathing hole extending through the body of the protruding section from the front end to the rear end, the at least one breathing hole set back form the front end.

Defined alternatively in detail, the present invention is a mouth guard comprising: (a) a teeth protecting means section including a front wall; and (b) a protruding section extending from the front wall of the teeth protecting means section, the protruding section having a body, a front end, a rear end, and three aligned breathing holes extending through the body of the protruding section from the front end to the rear end.

Defined alternatively more broadly, the present invention a mouthguard comprising: (a) a teeth protecting means section including a front wall; and (b) a protruding section extending from the front wall of the teeth protecting means section, the protruding section having a body, a front end, a rear end, and at least one breathing hole extending through the body of the protruding section from the front end to the rear end.

Defined most broadly, the present invention is a mouthguard to be retained in a wearer's mouth and protect a wearer's teeth, the wearer having a head with a mouth with teeth therein and a pair of lips, the mouthguard comprising: (a) a body having a section for protecting teeth and an extending section comprising at least one breathing hole extending there through; (b) whereby when the mouthguard is retained between a wearer's teeth at the body section for protecting teeth, the extending section extends between the wearer's lips so that air can pass from the area around the wearer's head into the wearer's mouth.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A mouthguard for protecting a wearer's upper row of teeth and lower row of teeth and used in conjunction with a wearer's pair of lips, the mouthguard comprising:

a. a teeth protecting section including a first upper teeth tray section having a first transverse wall, a first exterior wall extending upwardly from the first transverse wall and a first interior wall extending upwardly from the first transverse wall, a second teeth tray section having a second transverse wall, a second exterior wall extending upwardly from the second transverse wall and a second interior wall extending upwardly from the second transverse wall, and a middle teeth tray section having a middle transverse wall, a middle exterior wall extending upwardly from the middle transverse wall and a middle interior wall extending upwardly from the middle transverse wall, the three transverse walls aligned, the three exterior walls aligned and the three interior walls aligned so that when the upper row of teeth are placed in the mouthguard, the upper row of teeth rest on the three aligned transverse walls and are protected by the three aligned exterior walls adjacent the exterior of the upper row of teeth and by the three aligned interior walls adjacent the interior of the upper row of teeth;

b. a protruding section extending from a front of the middle exterior wall, the protruding section having a body, a front end, a rear end, and three aligned breathing holes set back from the front end and separated by a pair of spaced apart vertical walls and extending through the body of the protruding section from the front end to the rear end, the middle exterior wall having three aligned openings respectively aligned with the three breathing holes in the protruding section so that an air passage extends from the protruding section into the area of the mouthguard between the exterior middle wall and the interior middle wall;

c. the front of the protruding section extends forwardly from the wearer's teeth and between the wearer's lips when the mouthguard is worn in place and gripped between the upper row of teeth and lower row of teeth in the wearer's mouth, the front end of the protruding section configured to extend beyond the wearer's lips so that it is communication with the air around the wearer's head; and d. the mouthguard retained in the wearer's mouth only by the wearer's upper and lower rows of teeth and the wearer's lips.

2. The mouthguard in accordance with claim 1 further comprising a lower wall which is aligned with the first upper section, the second upper section and the upper middle section.

3. The mouthguard in accordance with claim 2 wherein the lower wall has a flat surface.

4. The mouthguard in accordance with claim 3 wherein the lower wall further comprises a pair of raised sections positioned adjacent a rear area beneath a respective transverse wall of the first and second upper teeth tray sections.

5. The mouthguard in accordance with claim 1 wherein said protruding section is generally rectangular in shape.

6. The mouthguard in accordance with claim 1 wherein the three breathing holes are each generally rectangular in shape.

7. The mouthguard in accordance with claim 1 wherein the mouthguard is formed of a single piece of material selected form the group consisting of rubber, resin, PVC, and various synthetic plastic compounds.

8. A mouthguard for protecting a wearer's upper row of teeth and lower row of teeth and used in conjunction with a wearer's pair of lips, the mouthguard comprising:

a. a teeth protecting section including a first upper teeth tray section having a first transverse wall, a first exterior wall extending upwardly from the first transverse wall and a first interior wall extending upwardly from the first transverse wall, a second teeth tray section having a second transverse wall, a second exterior wall extending upwardly from the second transverse wall and a second interior wall extending upwardly from the second transverse wall, and a middle teeth tray section having a middle transverse wall, a middle exterior wall extending upwardly from the middle transverse wall and a middle interior wall extending upwardly from the middle transverse wall, the three transverse walls aligned, the three exterior walls aligned and the three interior walls aligned so that when the upper row of teeth are placed in the mouthguard, the upper row of teeth rest on the three aligned transverse walls and are protected by the three aligned exterior walls adjacent the exterior of the upper row of teeth and by the three aligned interior walls adjacent the interior of the upper row of teeth;

b. a protruding section extending from a front of the middle exterior wall, the protruding section having a body, a front end, a rear end, and at least one breathing hole set back from the front end and extending through the body of the protruding section from the front end to the rear end, the middle exterior wall having at least one opening aligned with the at least one breathing hole in the protruding section so that an air passage extends from the protruding section into the area of the mouthguard between the exterior middle wall and the interior middle wall;

c. the front of the protruding section extends forwardly from the wearer's teeth and between the wearer's lips when the mouthguard is worn in place and gripped between the upper row of teeth and lower row of teeth in the wearer's mouth, the front end of the protruding section configured to extend beyond the wearer's lips so that it is communication with the air around the wearer's head; and d. the mouthguard retained in the wearer's mouth only by the wearer's upper and lower rows of teeth and the wearer's lips.

9. The mouthguard in accordance with claim 8 further comprising a lower wall which is aligned with the first upper section, the second upper section and the upper middle section.

10. The mouthguard in accordance with claim 9 wherein the lower wall has a flat surface.

11. The mouthguard in accordance with claim 10 wherein the lower wall further comprises a pair of raised sections positioned adjacent a rear area beneath a respective transverse wall of the first and second upper teeth tray sections.

12. The mouthguard in accordance with claim 10 wherein the mouthguard is formed of a single piece of material selected form the group consisting of rubber, resin, PVC, and various synthetic plastic compounds.

13. The mouthguard in accordance with claim 8 wherein said protruding section is generally rectangular in shape.

14. The mouthguard in accordance with claim 8 wherein the at least one breathing hole is generally rectangular in shape.

15. A mouthguard for protecting a wearer's upper row of teeth and lower row of teeth and used in conjunction with a wearer's pair of lips, the mouthguard comprising:

a. a teeth protecting section including a first upper teeth tray section having a first transverse wall, a first exterior wall extending upwardly from the first transverse wall and a first interior wall extending upwardly from the first transverse wall, a second teeth tray section having a second transverse wall, a second exterior wall extending upwardly from the second transverse wall and a second interior wall extending upwardly from the second transverse wall, and a middle teeth tray section having a middle transverse wall, a middle exterior wall extending upwardly from the middle transverse wall and a middle interior wall extending upwardly from the middle transverse wall, the three transverse walls aligned, the three exterior walls aligned and the three interior walls aligned so that when the upper row of teeth are placed in the mouthguard, the upper row of teeth rest on the three aligned transverse walls and are protected by the three aligned exterior walls adjacent the exterior of the upper row of teeth and by the three aligned interior walls adjacent the interior of the upper row of teeth;

b. a protruding section extending from a front of the middle exterior wall, the protruding section having a body, a front end, a rear end, and three aligned breathing holes and separated by a pair of spaced apart vertical walls and extending through the body of the protruding section from the front end to the rear end, the middle exterior wall having three aligned openings respectively aligned with the three breathing holes in the protruding section so that an air passage extends from the protruding section into the area of the mouthguard between the exterior middle wall and the interior middle wall;

c. the front of the protruding section extends forwardly from the wearer's teeth and between the wearer's lips when the mouthguard is worn in place and gripped between the upper row of teeth and lower row of teeth in the wearer's mouth, the front end of the protruding section configured to extend beyond the wearer's lips so that it is communication with the air around the wearer's head; and d. the mouthguard retained in the wearer's mouth only by the wearer's upper and lower rows of teeth and the wearer's lips.

16. The mouthguard in accordance with claim 15 further comprising a lower wall which is aligned with the first upper section, the second upper section and the upper middle section.

17. The mouthguard in accordance with claim 16 wherein the lower wall has a flat surface.

18. The mouthguard in accordance with claim 17 wherein the lower wall further comprises a pair of raised sections positioned adjacent a rear area beneath a respective transverse wall of the first and second upper teeth tray sections.

19. The mouthguard in accordance with claim 15 wherein said protruding section is generally rectangular in shape.

20. The mouthguard in accordance with claim 15 wherein the three breathing holes are each generally rectangular in shape.

21. The mouthguard in accordance with claim 15 wherein the mouthguard is formed of a single piece of material selected form the group consisting of rubber, resin, PVC, and various synthetic plastic compounds.

22. A mouthguard for protecting a wearer's upper row of teeth and lower row of teeth and used in conjunction with a wearer's pair of lips, the mouthguard comprising:

a. a teeth protecting section including a first upper teeth tray section having a first transverse wall, a first exterior wall extending upwardly from the first transverse wall and a first interior wall extending upwardly from the first transverse wall, a second teeth tray section having a second transverse wall, a second exterior wall extending upwardly from the second transverse wall and a second interior wall extending upwardly from the second transverse wall, and a middle teeth tray section having a middle transverse wall, a middle exterior wall extending upwardly from the middle transverse wall and a middle interior wall extending upwardly from the middle transverse wall, the three transverse walls aligned, the three exterior walls aligned and the three interior walls aligned so that when the upper row of teeth are placed in the mouthguard, the upper row of teeth rest on the three aligned transverse walls and are protected by the three aligned exterior walls adjacent the exterior of the upper row of teeth and by the three aligned interior walls adjacent the interior of the upper row of teeth;

b. a protruding section extending from a front of the middle exterior wall, the protruding section having a body, a front end, a rear end, and at least one breathing hole extending through the body of the protruding section from the front end to the rear end, the middle exterior wall having at least one opening aligned with the at least one breathing hole in the protruding section so that an air passage extends from the protruding section into the area of the mouthguard between the exterior middle wall and the interior middle wall;

c. the front of the protruding section extends forwardly from the wearer's teeth and between the wearer's lips when the mouthguard is worn in place and gripped between the upper row of teeth and lower row of teeth in the wearer's mouth, the front end of the protruding section configured to extend beyond the wearer's lips so that it is communication with the air around the wearer's head; and d. the mouthguard retained in the wearer's mouth only by the wearer's upper and lower rows of teeth and the wearer's lips.

23. The mouthguard in accordance with claim 22 further comprising a lower wall which is aligned with the first upper section, the second upper section and the upper middle section.

24. The mouthguard in accordance with claim 23 wherein the lower wall has a flat surface.

25. The mouthguard in accordance with claim 24 wherein the lower wall further comprises a pair of raised sections positioned adjacent a rear area beneath a respective transverse wall of the first and second upper teeth tray sections.

26. The mouthguard in accordance with claim 22 wherein said protruding section is generally rectangular in shape.

27. The mouthguard in accordance with claim 22 wherein the at least one breathing hole is generally rectangular in shape.

28. The mouthguard in accordance with claim 22 wherein the mouthguard is formed of a single piece of material selected form the group consisting of rubber, resin, PVC, and various synthetic plastic compounds.

* * * * *